US006484324B2

(12) United States Patent
Garofalo

(10) Patent No.: US 6,484,324 B2
(45) Date of Patent: Nov. 26, 2002

(54) OPTICAL DIVING MASK

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/737,856

(22) Filed: Dec. 18, 2000

(65) Prior Publication Data

US 2001/0023503 A1 Sep. 27, 2001

(30) Foreign Application Priority Data

Jan. 5, 2000 (IT) ..... GE000001 U

(51) Int. Cl.[7] ..... A61F 9/02
(52) U.S. Cl. ..... 2/428
(58) Field of Search ..... 2/428, 430, 441, 2/443

(56) References Cited

U.S. PATENT DOCUMENTS 5,345,615 A 9/1994 Garofalo
5,564,132 A * 10/1996 Kuo ..... 2/430
5,657,493 A * 8/1997 Ferrero et al. ..... 2/428
5,819,321 A 10/1998 Wang
6,192,523 B1 * 2/2001 Pan ..... 2/428
6,272,693 B1 * 8/2001 Godoy ..... 2/430

* cited by examiner

*Primary Examiner*—John J. Calvert
*Assistant Examiner*—Katherine Moran
(74) *Attorney, Agent, or Firm*—Larson & Taylor, PLC

(57) ABSTRACT

A diving mask, in particular to fit optical glasses, including a face of elastomeric material, provided with at least one opening, and a stiff body having at least one seat to house a glass or lens. Watertight elements are provided between the lens or glass and the seat, and a framework holds the lens or glass in the seat. Along a substantial part of the peripheral edge of the stiff body, on a plane substantially parallel to the plane of the lens or glass, guiding means are formed for the insertion of the framework into the seat.

9 Claims, 3 Drawing Sheets

OPTICAL DIVING MASK

BACKGROUND AND SUMMERY OF THE INVENTION

The present invention relates to diving masks, and in particular it relates to diving masks wherein it is possible to use corrective lenses instead of normal glass.

A problem which has existed for years in the production of diving masks is concerned with the possibility of making them suitable to fit both tempered non-corrective lenses and corrective lenses, to help those users needing such a correction. In many cases the most common way consisted of complicated interventions both by specialized opticians and the mask user himself. However these kinds of changes could only produce masks provided with fixed fitted lenses which were not adjustable in case of eventual changes in the user's visual defect.

One solution to this problem is offered by the mask described in U.S. Pat. No. 4056853.

That mask is provided with a fairly stiff plastic body having two seats to house two lenses. Around the two seats there are two U shaped relief edges opened to the side ends of the mask. In the edges there are two grooves which house two suitable frames sliding within the same grooves and provided with locking means.

An evident problem is the impossibility of changing the mask from a certain outline provided for by the molding of the stiff body. The user's choice of the shape of the mask is then strictly limited. In particular, this system appears to be little or not at all suitable for monocular type masks. Moreover, the assembly described above is difficult to use, and even its assembly seems to be difficult.

An aim of the present invention is then to provide a diving mask, in particular to fit optical glasses, which is easy to assemble and which allows a large choice among different shapes.

An object of the present invention is then to provide a diving mask, in particular to fit optical glasses, including a face of elastomeric material, provided with at least one opening, a stiff body having at least one housing seat for a glass or lens, and having watertight means between said lens or glass and said seat, and holding means for holding said lens or glass in said seat; wherein along a substantial part of the peripheral edge of the stiff body there is provided, in a plane substantially parallel to the plane of the lens or glass, guiding means for the insertion of the holding means of the lens or glass into the seat.

The guiding means can include a groove provided in the wall facing the inside of the stiff body in a relief which projects axially from the peripheral edge of the same. Advantageously, the relief and the groove extend substantially for half of the stiff body perimeter, and in particular for the half facing the diver's mouth.

The holding means can include a stiff frame, made of a plastic or metallic material, provided with means to lock the coupling between the frame and the stiff body.

BRIEF DESCRIPTION OF THE DRAWINGS

Further advantages and features of the present invention will be better understood from the following detailed description of an illustrative embodiment, not to be considered as a limitative description, with reference to the enclosed drawings, where.

DESCRIPTION OF THE PREFERRED EMBODIMENT OF THE INVENTION

Figure 1:
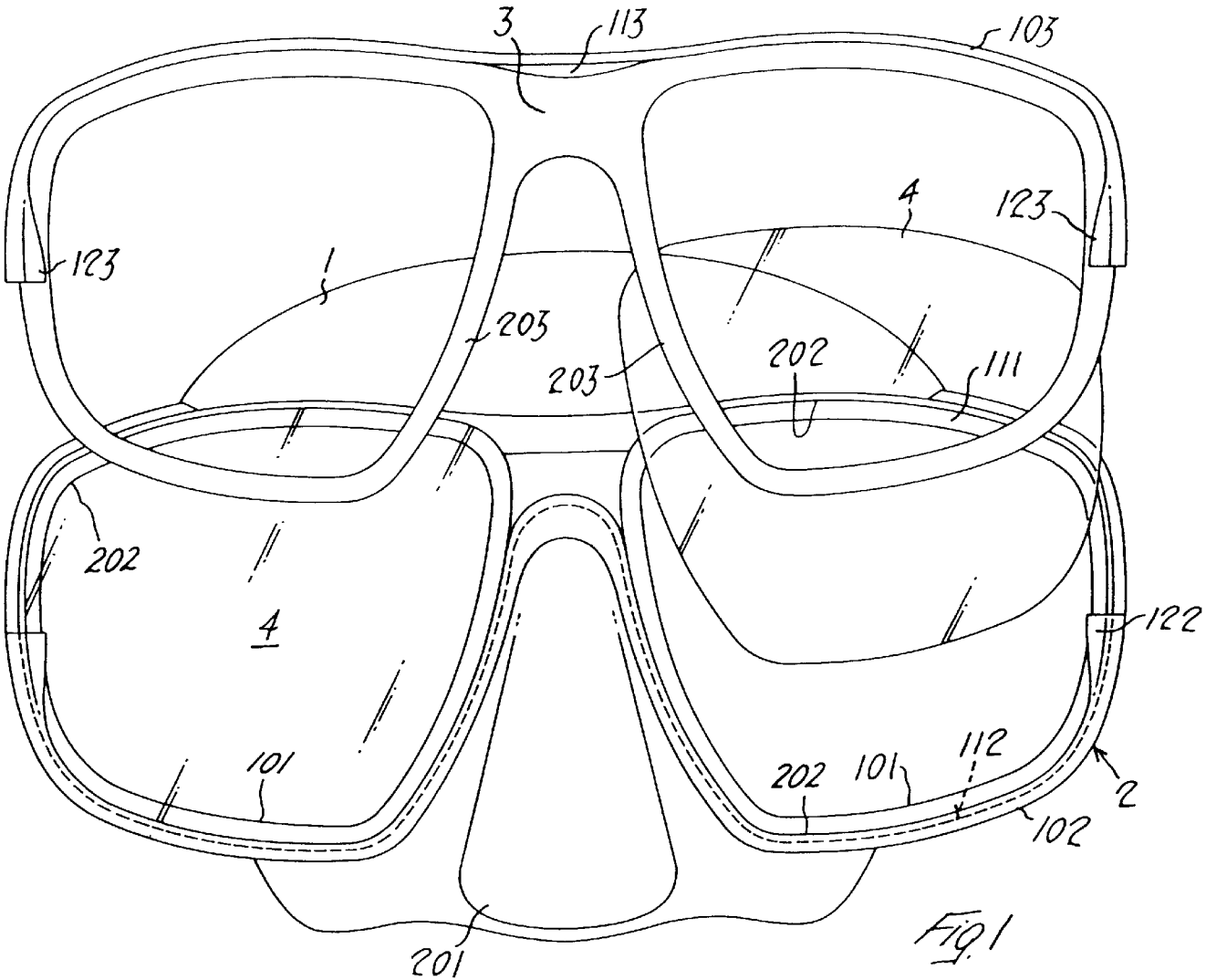
FIG. 1 is a front elevation view with exploded parts of an embodiment of the mask according to the present invention.

FIG. 1 shows a mask according to the present invention; with 1 indicating the face of said mask, provided in the illustrated embodiment with two openings 101 corresponding to the two ocular elements, namely two glasses 4, and the compartment 201 which receives the diver's nose. The mask includes a stiff body 2, normally made of thermoplastic material, having formed therein two seats 202 adapted to house the glasses 4. In the seats 202 are set the watertight elements 111, formed as part of the material of the face 1.

Along the peripheral edge of the stiff body 2, in the part facing toward the compartment 201, there is provided a relief 102 projecting axially from said body 2, wherein there is provided, on the wall facing the inside, a groove 112. In the groove 112 there is inserted a frame 3, adapted to keep the glasses 4 in contact with the watertight elements 111 in the seats 202. The frame 3 is provided, on its edge opposite the edges designed to cooperate with the groove 112 of the relief 102, with a framework 103 which is coextensive with the relief 102, to which is connected through the insertion into cavities formed by clips 113, 122 and 123.

Figure 2:
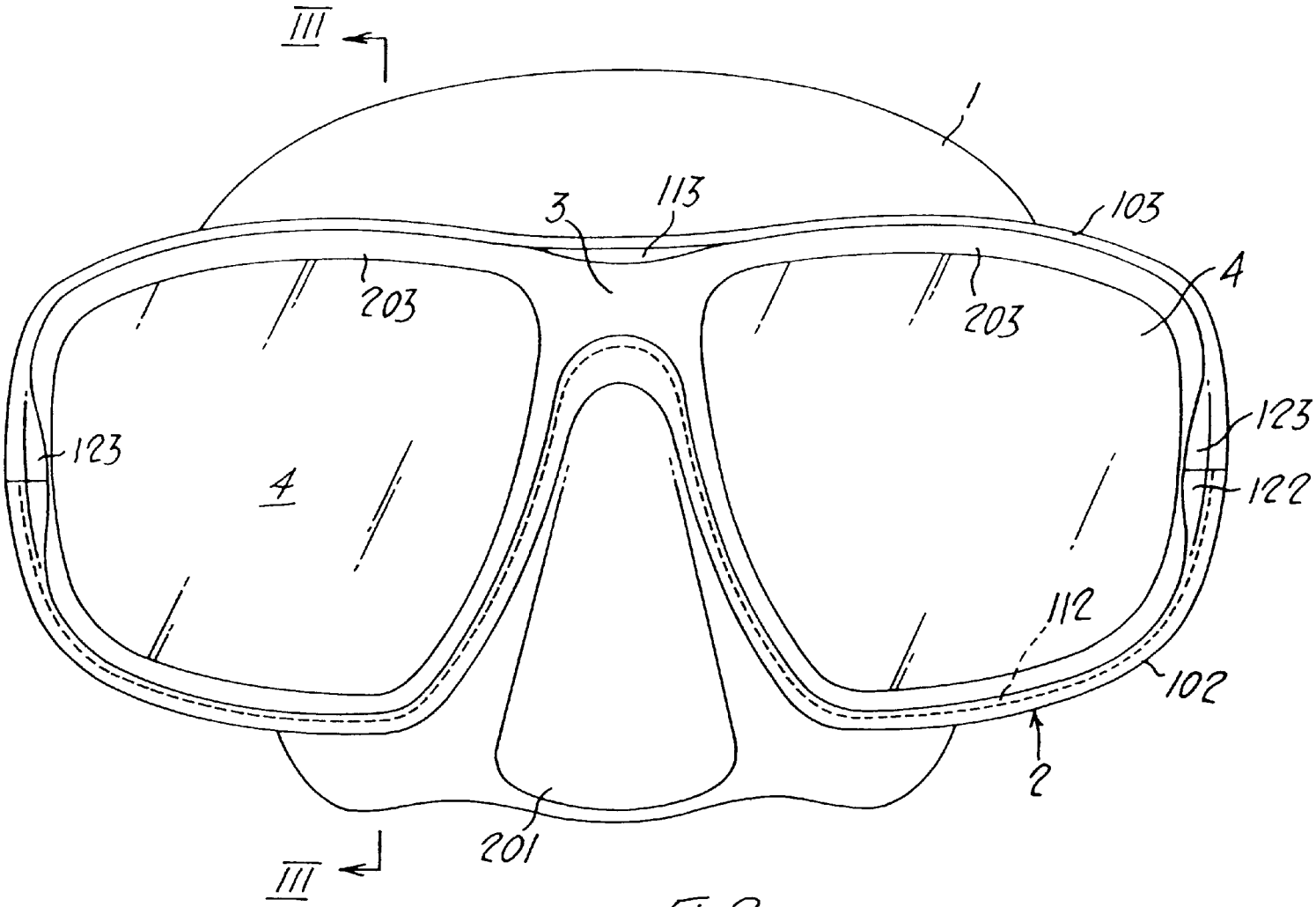
FIG. 2 is a front elevation view of the mask shown in FIG. 1, fully assembled.
Figure 3:
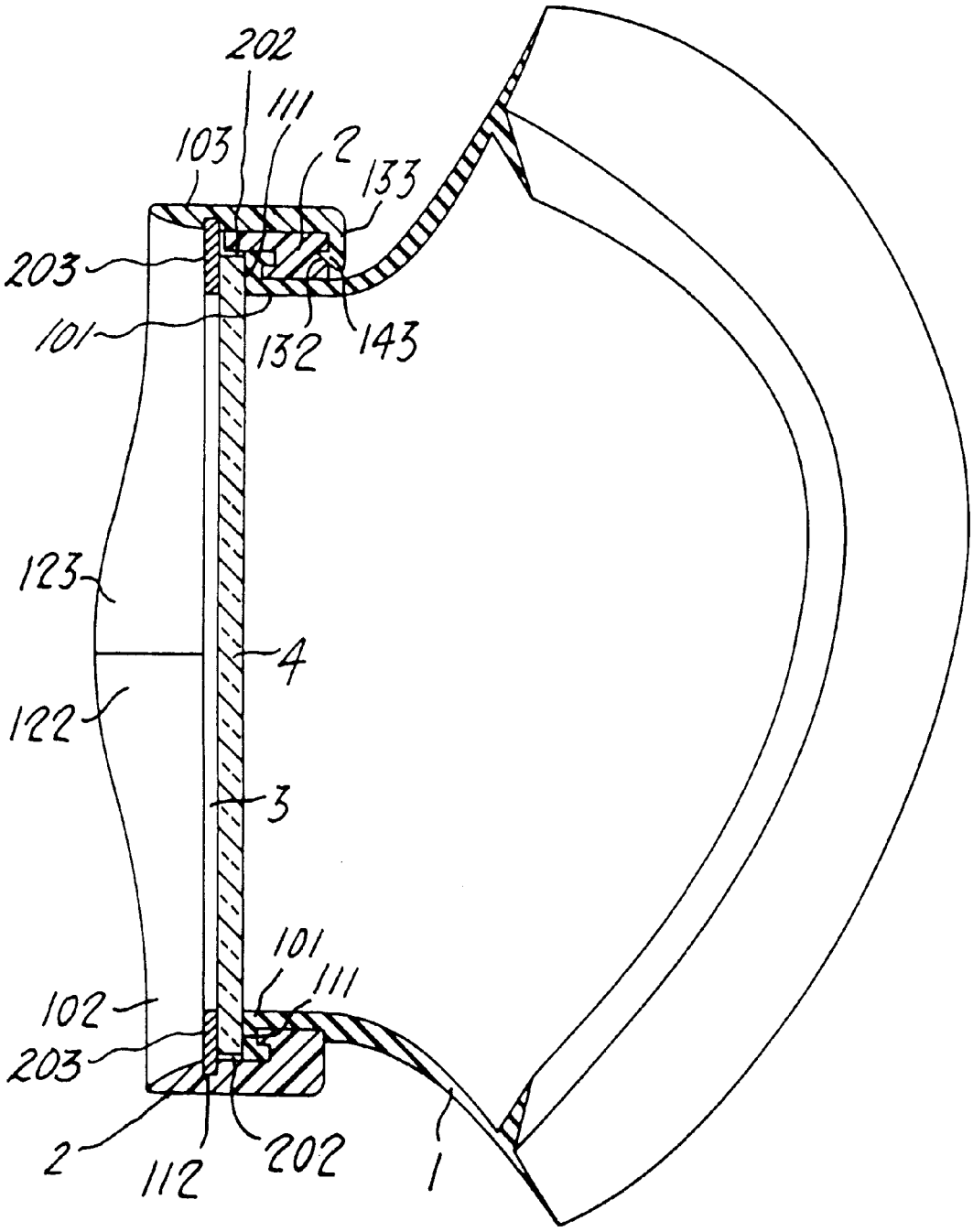
FIG. 3 is a section view along the line III—III of FIG. 2.

As appearing from FIG. 2, a substantial part of the edge 203 of frame 3 is housed in the groove 112 of the relief 102 projecting from the body 2. FIG. 3 shows the section along the line III—III of FIG. 2. In the part of the frame 103 facing the face 1 of the mask there is provided a fin 133 bent towards the body 2, whose free end is a tooth relief 143, cooperating with a complementary cavity 132 formed in the body 2. FIG. 3 also illustrates the action of the frame 3 on the edge of the glasses 4, which are brought into contact with the watertight elements 111 in the seats 202.

The functioning of the mask according to the present invention will be better understood from the following. In FIG. 1 the mask is shown during the assembling. One of the two glasses 4 has already been inserted in the suitable hollow seat 202 in the body 2 In the seat 202 watertightness is guaranteed by the element 111, which is formed from the same piece of the mask face 1. As is clear from FIG. 3, the large contact surface between the glasses 4 and the element 111 guarantees a good sealing. The body 2 with the inserted glasses 4 is then inserted into the frame 3, whose edges 203 are positioned into the groove 112. The part of the frame not inserted in the groove 112 is coupled to the framework 103, which carries the connection means with the body 2 by way of one or more fins 133 provided with tooth relief 143 which cooperates with the cavities 132 formed on the body 2.

It appears clear that the present solution allows absolute freedom from the point of view of the choice of the shapes of the stiff body. In fact, the grooves 112 are formed in the inner wall of the relief 102 projecting from the peripheral edge of the body 2. Then for any different perimeter a different groove will be provided to house a suitably shaped frame, while the mask described in the U.S. patent mentioned above has a practically compulsory shape. Moreover, even though in this case there is shown a two ocular opening mask, the present invention is suitable for a one ocular opening mask as well.

It is also advantageous to use just one frame to hold both the glasses, or lenses, in the case of two ocular openings as shown. This use appears much easier for the user and the glasses or lenses changing operations are very easy and quick.

The mask so devised makes it much easier to use optical lenses or optically corrected glasses, without necessarily influencing the choice of the shape of the mask itself.

I claim:

1. A diving mask, adapted to accommodate optical glasses, comprising a face piece of elastomeric material, provided with at least one opening, a stiff body having at least one seat, a glass or lens housed in said seat; watertight means between said lens or glass and said seat, holding means for holding said lens or glass in said seat; and guiding means formed along the lower part of the peripheral edge of said stiff body, in a plane substantially parallel to the plane of the said lens or glass, for the insertion of the holding means of said lens or glass into said seat and including an upper framework, separate from the stiff body, and located on the upper part of the periphery of the optical glasses, the holding means being held by the upper framework along the upper part of the optical glasses.

2. A diving mask according to claim 1, where said guiding means comprises a groove positioned on a relief axially projecting from a peripheral edge of an inside wall of the stiff body.

3. A diving mask according to claim 2, wherein said relief and said groove extend around substantially the lower half of the perimeter of the stiff body.

4. A mask according to claim 1, wherein the said glass or lens holding means includes a stiff frame shaped to follow the perimeter edge of said glass or lens, and including locking means at the interface between said upper framework and said stiff body.

5. A diving mask according to claim 4, where said locking means comprises at least one fin bent toward the face piece of said mask, the free end of the at least one fin being provided with a tooth relief adapted to be inserted in a cavity on the stiff body.

6. A diving mask according to claim 5, wherein said upper framework includes at least one clip forming a cavity for receiving the stiff frame.

7. A diving mask according to claim 1, wherein said watertight elements are part of the same piece of material as said face piece.

8. A diving mask according to claim 1, wherein the holding means comprises a generally planer member, the guiding means comprising a groove in the stiff body, which groove receives the lower part of the planer member holding means, and the upper framework including a groove which receives the upper part of the planer member holding means.

9. A diving mask according to claim 1, wherein the diving mask comprises two openings, each having its own lens or glass and its own holding means.

* * * * *